US011501910B2

(12) United States Patent
Hirukawa et al.

(10) Patent No.: US 11,501,910 B2
(45) Date of Patent: Nov. 15, 2022

(54) MULTILAYER COIL COMPONENT

(71) Applicant: Murata Manufacturing Co., Ltd., Kyoto-fu (JP)

(72) Inventors: Atsuo Hirukawa, Nagaokakyo (JP); Yuki Nishikawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 315 days.

(21) Appl. No.: 16/881,395

(22) Filed: May 22, 2020

(65) Prior Publication Data

US 2020/0373067 A1 Nov. 26, 2020

(30) Foreign Application Priority Data

May 24, 2019 (JP) ..... JP2019-097643

(51) Int. Cl.
*H01F 27/28* (2006.01)
*H01F 27/29* (2006.01)
*H01F 17/00* (2006.01)

(52) U.S. Cl.
CPC ..... *H01F 27/2804* (2013.01); *H01F 17/0013* (2013.01); *H01F 27/292* (2013.01); *H01F 2027/2809* (2013.01)

(58) Field of Classification Search
CPC ..... H01F 17/0013; H01F 27/292; H01F 2027/2809; H01F 27/2804
See application file for complete search history.

(56) References Cited

U.S. PATENT DOCUMENTS

2014/0145816 A1* 5/2014 Sato ..... H01F 17/0013 336/208
2015/0084729 A1* 3/2015 Lee ..... H01F 17/0013 336/192
2017/0345552 A1* 11/2017 Nakano ..... H01F 27/292

FOREIGN PATENT DOCUMENTS

JP 2000-138120 A 5/2000
JP 2005-038904 A 2/2005
JP 2008066594 A * 3/2008
JP 2017-212372 A 11/2017

OTHER PUBLICATIONS

Takesue, Masafumi, Hiromichi Hayashi, and Richard L. Smith Jr. "Thermal and chemical methods for producing zinc silicate (willemite): a review." Progress in Crystal Growth and Characterization of Materials 55.3-4 (2009): 98-124. (Year: 2009).*

* cited by examiner

*Primary Examiner* — Ryan Johnson
(74) *Attorney, Agent, or Firm* — Studebaker & Brackett PC

(57) ABSTRACT

A multilayer coil component includes a multilayer body formed by stacking a plurality of insulating layers in a length direction and that has a built-in coil, and a first outer electrode and a second outer electrode that are electrically connected to the coil. The coil is formed by a plurality of coil conductors stacked in the length direction being electrically connected to each other. The first and second outer electrodes respectively cover parts of first and second end surfaces and parts of a first main surface. The multilayer body includes a low-dielectric-constant portion, which is centrally arranged, and high-dielectric-constant portions, which are arranged at both ends in the stacking direction. The length of a region in which the coil conductors are (Continued)

arranged in the stacking direction lies in a range from 85% to 90% of a length of the multilayer body.

20 Claims, 4 Drawing Sheets

MULTILAYER COIL COMPONENT

CROSS-REFERENCE TO RELATED APPLICATION

This application claims benefit of priority to Japanese Patent Application No. 2019-097643, filed May 24, 2019, the entire content of which is incorporated herein by reference.

BACKGROUND

Technical Field

The present disclosure relates to a multilayer coil component.

Background Art

As an example of a coil component, Japanese Unexamined Patent Application Publication No. 2017-212372 discloses a coil component in which the stacking direction and the coil axis are both parallel to the mounting surface of the coil component.

In the coil component disclosed in Japanese Unexamined Patent Application Publication No. 2017-212372, an element body that includes a coil-shaped conductor part includes a first part, a second part, and a third part that are sequentially arranged in a direction parallel to a center axis of the coil. The glass content of the second part is higher than that of the first part and the third part, and the coil component has good characteristics in a high-frequency band located at around 10 GHz. However, in response to the increasing communication speed and miniaturization of electronic devices in recent years, it is demanded that multilayer inductors have satisfactory radio-frequency characteristics in higher frequency bands (for example, a GHz band located at frequencies greater than or equal to 50 GHz). There is a problem with the coil component disclosed in Japanese Unexamined Patent Application Publication No. 2017-212372 in that the radio-frequency characteristics of the coil component are not satisfactory in a band located at frequencies greater than or equal to 50 GHz.

SUMMARY

Accordingly, the present disclosure provides a multilayer coil component that has excellent radio-frequency characteristics.

A multilayer coil component according to a preferred embodiment of the present disclosure includes a multilayer body that is formed by stacking a plurality of insulating layers on top of one another in a length direction and that has a coil built into the inside thereof; and a first outer electrode and a second outer electrode that are electrically connected to the coil. The coil is formed by a plurality of coil conductors stacked in the length direction together with the insulating layers being electrically connected to each other. The multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction. The first outer electrode extends along and covers part of the first end surface and part of the first main surface. The second outer electrode extends along and covers part of the second end surface and part of the first main surface. The first main surface is a mounting surface. A stacking direction of the multilayer body and a coil axis direction of the coil are parallel to the first main surface. The multilayer body includes a low-dielectric-constant portion, which is centrally arranged in the stacking direction and has a comparatively low relative dielectric constant, and high-dielectric-constant portions, which are arranged at both ends in the stacking direction and have a comparatively high dielectric constant. A length of a region in which the coil conductors are arranged in the stacking direction lies in a range from 85% to 90% of a length of the multilayer body. The number of stacked coil conductors lies in a range from 50 to 60. The total number of stacked coil conductors included in the high-dielectric-constant portions is less than or equal to 8.

According to the preferred embodiment of the present disclosure, a multilayer coil component can be provided that has excellent radio-frequency characteristics.

Other features, elements, characteristics and advantages of the present disclosure will become more apparent from the following detailed description of preferred embodiments of the present disclosure with reference to the attached drawings.

DETAILED DESCRIPTION

Hereafter, a multilayer coil component according to an embodiment of the present disclosure will be described. However, the present disclosure is not limited to the following embodiment and the present disclosure can be applied with appropriate modifications within a range that does not alter the gist of the present disclosure. Combinations consisting of two or more desired configurations among the configurations described below are also included in the scope of the present disclosure.

Figure 1:
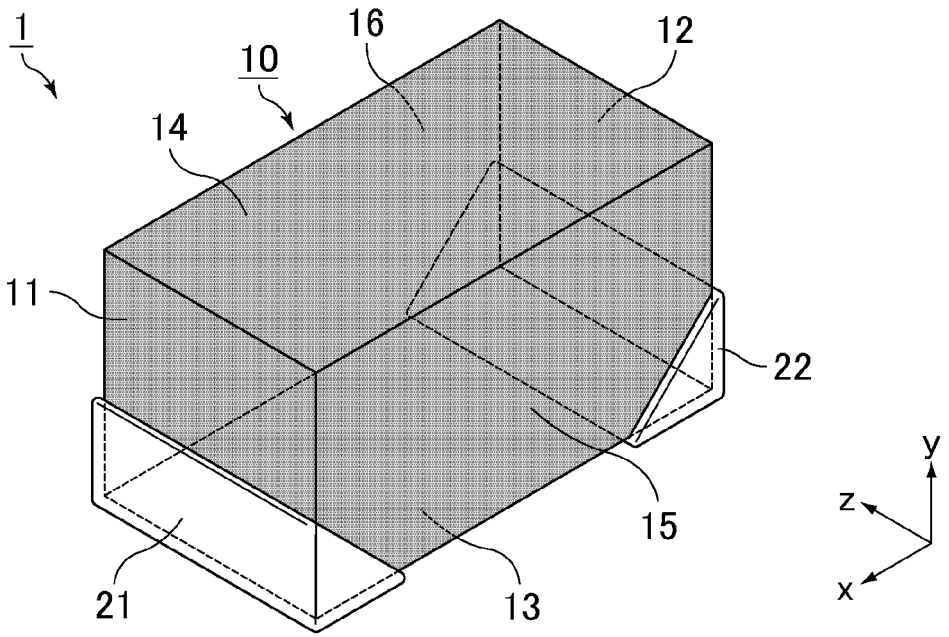
FIG. 1 is a perspective view schematically illustrating an example of a multilayer coil component according to an embodiment of the present disclosure.
Figure 2A:
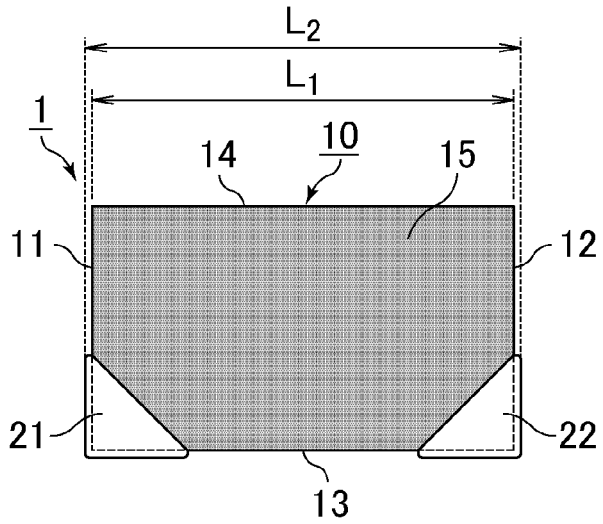
FIG. 2A is a side view of the multilayer coil component illustrated in FIG. 1.
Figure 2B:
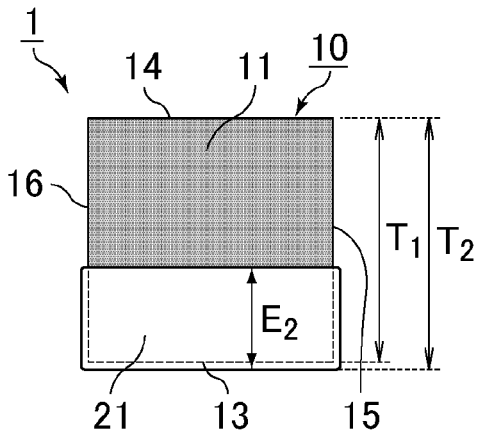
FIG. 2B is a front view of the multilayer coil component illustrated in FIG. 1.
Figure 2C:
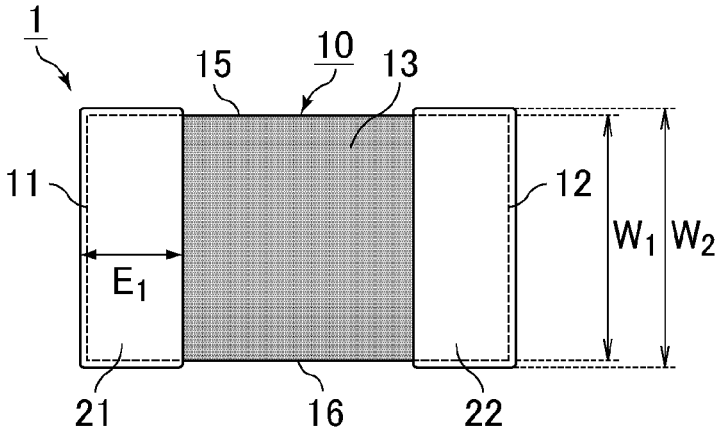
FIG. 2C is a bottom view of the multilayer coil component illustrated in FIG. 1.

FIG. 1 is a perspective view schematically illustrating an example of a multilayer coil component according to an embodiment of the present disclosure. FIG. 2A is a side view of the multilayer coil component illustrated in FIG. 1, FIG. 2B is a front view of the multilayer coil component illustrated in FIG. 1, and FIG. 2C is a bottom view of the multilayer coil component illustrated in FIG. 1.

A multilayer coil component 1 illustrated in FIGS. 1, 2A, 2B, and 2C includes a multilayer body 10, a first outer electrode 21, and a second outer electrode 22. The multilayer body 10 has a substantially rectangular parallelepiped shape having six surfaces. The configuration of the multilayer body 10 will be described later, but the multilayer body 10 is formed by stacking a plurality of insulating layers on top of one another in a length direction and has a coil built into the inside thereof. The first outer electrode 21 and the second outer electrode 22 are electrically connected to the coil.

In the multilayer coil component 1 and the multilayer body 10 of the embodiment of the present disclosure, a length direction, a height direction, and a width direction are respectively an x direction, a y direction, and a z direction in FIG. 1. Here, the length direction (x direction), the height direction (y direction), and the width direction (z direction) are perpendicular to each other.

As illustrated in FIGS. 1, 2A, 2B, and 2C, the multilayer body 10 has a first end surface 11 and a second end surface 12, which face each other in the length direction (x direction), a first main surface 13 and a second main surface 14, which face each other in the height direction (y direction) perpendicular to the length direction, and a first side surface 15 and a second side surface 16, which face each other in the width direction (z direction) perpendicular to the length direction and the height direction.

Although not illustrated in FIG. 1, corner portions and edge portions of the multilayer body 10 are preferably rounded. The term "corner portion" refers to a part of the multilayer body 10 where three surfaces intersect and the term "edge portion" refers to a part of the multilayer body 10 where two surfaces intersect.

The first outer electrode 21 is arranged so as to cover part of the first end surface 11 of the multilayer body 10 as illustrated in FIGS. 1 and 2B and so as to extend from the first end surface 11 and cover part of the first main surface 13 of the multilayer body 10, as illustrated in FIGS. 1 and 2C. As illustrated in FIG. 2B, the first outer electrode 21 covers a region of the first end surface 11 that includes the edge portion that intersects the first main surface 13, and may extend from the first end surface 11 so as to cover the second main surface 14.

In FIG. 2B, the height of the part of the first outer electrode 21 that covers the first end surface 11 of the multilayer body 10 is constant, but the shape of the first outer electrode 21 is not particularly limited so long as the first outer electrode 21 covers part of the first end surface 11 of the multilayer body 10. For example, the first outer electrode 21 may have an arch-like shape that increases in height from the ends thereof toward the center thereof on the first end surface 11 of the multilayer body 10. In addition, in FIG. 2C, the length of the part of the first outer electrode 21 that covers the first main surface 13 of the multilayer body 10 is constant, but the shape of the first outer electrode 21 is not particularly limited so long as the first outer electrode 21 covers part of the first main surface 13 of the multilayer body 10. For example, the first outer electrode 21 may have an arch-like shape that increases in length from the ends thereof toward the center thereof on the first main surface 13 of the multilayer body 10.

As illustrated in FIGS. 1 and 2A, the first outer electrode 21 may be additionally arranged so as to extend from the first end surface 11 and the first main surface 13 and cover part of the first side surface 15 and part of the second side surface 16. In this case, as illustrated in FIG. 2A, the parts of the first outer electrode 21 covering the first side surface 15 and the second side surface 16 are preferably formed in a diagonal shape relative to both the edge portion that intersects the first end surface 11 and the edge portion that intersects the first main surface 13. However, the first outer electrode 21 does not have to be arranged so as to cover part of the first side surface 15 and part of the second side surface 16.

The second outer electrode 22 is arranged so as to cover part of the second end surface 12 of the multilayer body 10 and so as to extend from the second end surface 12 and cover part of the first main surface 13 of the multilayer body 10. Similarly to the first outer electrode 21, the second outer electrode 22 covers a region of the second end surface 12 that includes the edge portion that intersects the first main surface 13. In addition, similarly to the first outer electrode 21, the second outer electrode 22 may extend from the second end surface 12 and cover part of the second main surface 14, part of the first side surface 15, and part of the second side surface 16.

Similarly to the first outer electrode 21, the shape of the second outer electrode 22 is not particularly limited so long as the second outer electrode 22 covers part of the second end surface 12 of the multilayer body 10. For example, the second outer electrode 22 may have an arch-like shape that increases in height from the ends thereof toward the center thereof on the second end surface 12 of the multilayer body 10. Furthermore, the shape of the second outer electrode 22 is not particularly limited so long as the second outer electrode 22 covers part of the first main surface 13 of the multilayer body 10. For example, the second outer electrode 22 may have an arch-like shape that increases in length from the ends thereof toward the center thereof on the first main surface 13 of the multilayer body 10.

Similarly to the first outer electrode 21, the second outer electrode 22 may be additionally arranged so as to extend from the second end surface 12 and the first main surface 13 and cover part of the second main surface 14, part of the first side surface 15, and part of the second side surface 16. In this case, the parts of the second outer electrode 22 covering the first side surface 15 and the second side surface 16 are preferably formed in a diagonal shape relative to both the edge portion that intersects the second end surface 12 and the edge portion that intersects the first main surface 13. However, the second outer electrode 22 does not have to be arranged so as to cover part of the second main surface 14, part of the first side surface 15, and part of the second side surface 16.

The first outer electrode 21 and the second outer electrode 22 are arranged in the manner described above, and therefore the first main surface 13 of the multilayer body 10 serves as a mounting surface when the multilayer coil component 1 is mounted on a substrate.

Although the size of the multilayer coil component 1 according to the embodiment of the present disclosure is not particularly limited, the multilayer coil component 1 is preferably the 0603 size, the 0402 size, or the 1005 size.

In the case where the multilayer coil component 1 according to the embodiment of the present disclosure is the 0603 size, the length of the multilayer body 10 (length indicated by double-headed arrow $L_1$ in FIG. 2A) preferably lies in a range from 0.57 mm to 0.63 mm and more preferably lies in a range from 0.56 mm (560 μm) to 0.60 mm (600 μm). In the case where the multilayer coil component 1 according to the embodiment of the present disclosure is the 0603 size, the width of the multilayer body 10 (length indicated by double-headed arrow $W_1$ in FIG. 2C) preferably lies in a range from 0.27 mm to 0.33 mm. In the case where the multilayer coil component 1 according to the embodiment of the present disclosure is the 0603 size, the height of the multilayer body 10 (length indicated by double-headed arrow $T_1$ in FIG. 2B) preferably lies in a range from 0.27 mm to 0.33 mm.

In the case where the multilayer coil component 1 according to the embodiment of the present disclosure is the 0603 size, the length of the multilayer coil component 1 (length indicated by double arrow $L_2$ in FIG. 2A) preferably lies in a range from 0.57 mm to 0.63 mm. In the case where the multilayer coil component 1 according to the embodiment of the present disclosure is the 0603 size, the width of the multilayer coil component 1 (length indicated by double-headed arrow $W_2$ in FIG. 2C) preferably lies in a range from 0.27 mm to 0.33 mm. In the case where the multilayer coil component 1 according to the embodiment of the present disclosure is the 0603 size, the height of the multilayer coil component 1 (length indicated by double-headed arrow $T_2$ in FIG. 2B) preferably lies in a range from 0.27 mm to 0.33 mm.

In the case where the multilayer coil component 1 according to the embodiment of the present disclosure is the 0603 size, the length of the part of the first outer electrode 21 that covers the first main surface 13 of the multilayer body 10 (length indicated by double-headed arrow $E_1$ in FIG. 2C) preferably lies in a range from 0.12 mm to 0.22 mm. Similarly, the length of the part of the second outer electrode 22 that covers the first main surface 13 of the multilayer body 10 preferably lies in a range from 0.12 mm to 0.22 mm. Additionally, in the case where the length of the part of the first outer electrode 21 that covers the first main surface 13 of the multilayer body 10 and the length of the part of the second outer electrode 22 that covers the first main surface 13 of the multilayer body 10 are not constant, it is preferable that the lengths of the longest parts thereof lie within the above-described range.

In the case where the multilayer coil component 1 according to the embodiment of the present disclosure is the 0603 size, the height of the part of the first outer electrode 21 that covers the first end surface 11 of the multilayer body 10 (length indicated by double-headed arrow $E_2$ in FIG. 2B) preferably lies in a range from 0.10 mm to 0.20 mm. Similarly, the height of the part of the second outer electrode 22 that covers the second end surface 12 of the multilayer body 10 preferably lies in a range from 0.10 mm to 0.20 mm. In this case, stray capacitances arising from the outer electrodes 21 and 22 can be reduced. In the case where the height of the part of the first outer electrode 21 that covers the first end surface 11 of the multilayer body 10 and the height of the part of the second outer electrode 22 that covers the second end surface 12 of the multilayer body 10 are not constant, it is preferable that the heights of the highest parts thereof lie within the above-described range.

In the case where the multilayer coil component 1 according to the embodiment of the present disclosure is the 0402 size, the length of the multilayer body 10 preferably lies in a range from 0.38 mm to 0.42 mm and the width of the multilayer body 10 preferably lies in a range from 0.18 mm to 0.22 mm. In the case where the multilayer coil component 1 according to the embodiment of the present disclosure is the 0402 size, the height of the multilayer body 10 preferably lies in a range from 0.18 mm to 0.22 mm.

In the case where the multilayer coil component 1 according to the embodiment of the present disclosure is the 0402 size, the length of the multilayer coil component 1 preferably lies in a range from 0.38 mm to 0.42 mm. In the case where the multilayer coil component 1 according to the embodiment of the present disclosure is the 0402 size, the width of the multilayer coil component 1 preferably lies in a range from 0.18 mm to 0.22 mm. In the case where the multilayer coil component 1 according to the embodiment of the present disclosure is the 0402 size, the height of the multilayer coil component 1 preferably lies in a range from 0.18 mm to 0.22 mm.

In the case where the multilayer coil component 1 according to the embodiment of the present disclosure is the 0402 size, the length of the part of the first outer electrode 21 that covers the first main surface 13 of the multilayer body 10 preferably lies in a range from 0.08 mm to 0.15 mm. Similarly, the length of the part of the second outer electrode 22 that covers the first main surface 13 of the multilayer body 10 preferably lies in a range from 0.08 mm to 0.15 mm.

In the case where the multilayer coil component 1 according to the embodiment of the present disclosure is the 0402 size, the height of the part of the first outer electrode 21 that covers the first end surface 11 of the multilayer body 10 preferably lies in a range from 0.06 mm to 0.13 mm. Similarly, the height of the part of the second outer electrode 22 that covers the second end surface 12 of the multilayer body 10 preferably lies in a range from 0.06 min to 0.13 mm. In this case, stray capacitances arising from the outer electrodes 21 and 22 can be reduced.

In the case where the multilayer coil component 1 according to the embodiment of the present disclosure is the 1005 size, the length of the multilayer body 10 preferably lies in a range from 0.95 mm to 1.05 mm and the width of the multilayer body 10 preferably lies in a range from 0.45 mm to 0.55 mm. In the case where the multilayer coil component 1 according to the embodiment of the present disclosure is the 1005 size, the height of the multilayer body 10 preferably lies in a range from 0.45 mm to 0.55 mm.

In the case where the multilayer coil component 1 according to the embodiment of the present disclosure is the 1005 size, the length of the multilayer coil component 1 preferably lies in a range from 0.95 mm to 1.05 mm. In the case where the multilayer coil component 1 according to the embodiment of the present disclosure is the 1005 size, the width of the multilayer coil component 1 preferably lies in a range from 0.45 mm to 0.55 mm. In the case where the multilayer coil component 1 according to the embodiment of the present disclosure is the 1005 size, the height of the multilayer coil component 1 preferably lies in a range from 0.45 mm to 0.55 mm.

In the case where the multilayer coil component 1 according to the embodiment of the present disclosure is the 1005 size, the length of the part of the first outer electrode 21 that covers the first main surface 13 of the multilayer body 10 preferably lies in a range from 0.20 mm to 0.38 mm. Similarly, the length of the part of the second outer electrode 22 that covers the first main surface 13 of the multilayer body 10 preferably lies in a range from 0.20 mm to 0.38 mm.

In the case where the multilayer coil component 1 according to the embodiment of the present disclosure is the 1005 size, the height of the part of the first outer electrode 21 that covers the first end surface 11 of the multilayer body 10 preferably lies in a range from 0.15 mm to 0.33 mm. Similarly, the height of the part of the second outer electrode 22 that covers the second end surface 12 of the multilayer body 10 preferably lies in a range from 0.15 mm to 0.33 mm. In this case, stray capacitances arising from the outer electrodes 21 and 22 can be reduced.

In the multilayer coil component 1 according to the embodiment of the present disclosure, insulating layers located between coil conductors are composed of a material containing at least one out of a magnetic material and a non-magnetic material. The multilayer body 10 includes a low-dielectric-constant portion, which is arranged in the center in the stacking direction and has a comparatively low relative dielectric constant, and high-dielectric-constant portions, which are arranged at both ends in the stacking direction and have a comparatively high dielectric constant.

Figure 3:
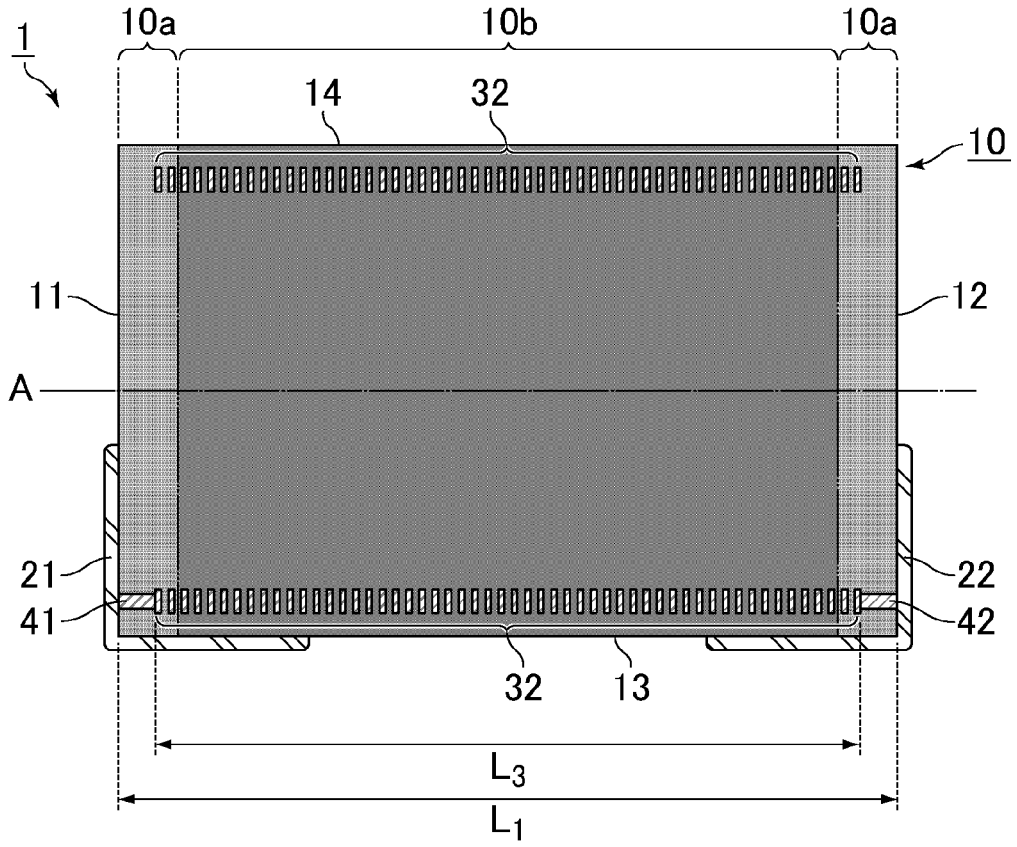
FIG. 3 is a sectional view schematically illustrating the internal structure of the multilayer coil component.

FIG. 3 is a sectional view schematically illustrating the internal structure of the multilayer coil component 1. FIG. 3 illustrates insulating layers, coil conductors, connection conductors, and a stacking direction of the multilayer body 10 in a schematic manner, and the actual shapes, connections, and so forth are not depicted with strict accuracy. For example, the coil conductors are connected to each other by via conductors.

As illustrated in FIG. 3, the multilayer coil component 1 includes a multilayer body 10 in which a plurality of insulating layers are stacked on top of one another and that has a coil built into the inside thereof. The coil is formed by electrically connecting a plurality of coil conductors 32, which are stacked together with the insulating layers, to one another. The stacking direction of the multilayer body 10 and the axial direction of the coil (coil axis is denoted by A in FIG. 3) are parallel to the first main surface 13, which is the mounting surface. The multilayer body 10 includes a low-dielectric-constant portion 10*b*, which has a comparatively low relative dielectric constant, and high-dielectric-constant portions 10*a*, which have a comparatively high dielectric constant. The low-dielectric-constant portion 10*b* is arranged at the substantially central region of the multilayer body 10 in the stacking direction and the high-dielectric-constant portions 10*a* are arranged at both ends of the multilayer body 10 in the stacking direction. Since the low-dielectric-constant portion 10*b* is provided at the substantially central region of the multilayer body 10 in the stacking direction, stray capacitances generated between the coil conductors can be reduced and the radio-frequency characteristics can be improved.

In FIG. 3, a length L3 of the region in which the coil conductors 32 are arranged in the stacking direction lies in a range from 85% to 95% (90% in FIG. 3) of the length $L_1$ of the multilayer body 10.

Figure 4:
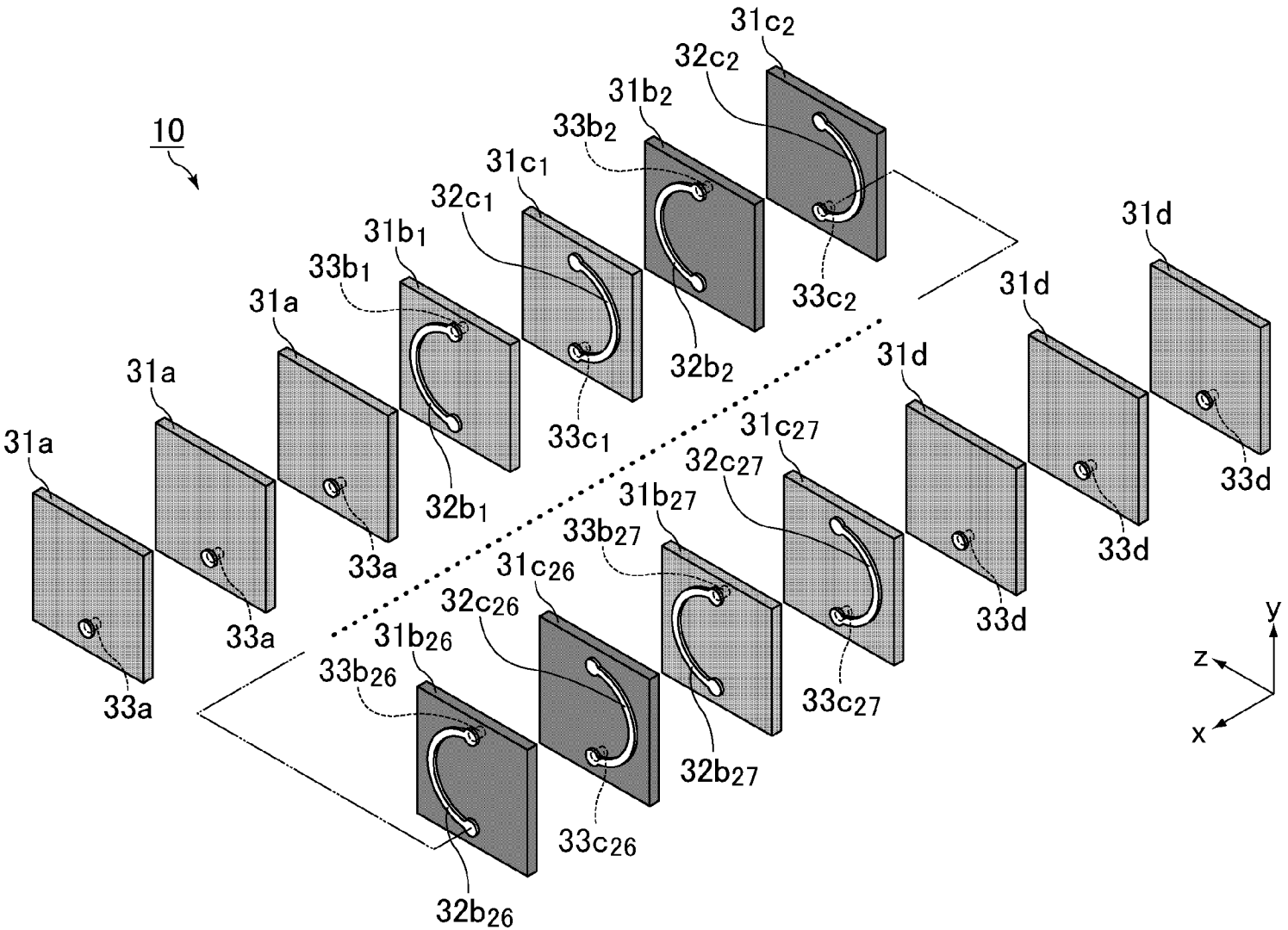
FIG. 4 is an exploded perspective view schematically illustrating an example of a multilayer body of the multilayer coil component illustrated in FIG. 3.

FIG. 4 is an exploded perspective view schematically illustrating an example of the multilayer body 10 of the multilayer coil component 1 illustrated in FIG. 3.

As illustrated in FIG. 4, the multilayer body 10 is formed by stacking a plurality of insulating layers 31*a*, 31*b* (31*b*$_1$ to 31*b*$_{27}$), 31*c* (31*c*$_1$ to 31*c*$_{27}$), and 31*d* in the length direction (x direction). The direction in which the plurality of insulating layers of the multilayer body 10 are stacked is called the stacking direction. In other words, in the multilayer coil component 1 of the embodiment of the present disclosure, the length direction of the multilayer body 10 and the stacking direction match each other.

Coil conductors 32*b* (32*b*$_1$ to 32*b*$_{27}$) and 32*c* (32*c*$_1$ to 32*c*$_{27}$) and via conductors 33*b* (33*b*$_1$ to 33*b*$_{27}$) and 33*c* (33*c*$_1$ to 33*c*$_{27}$) are respectively provided on and in the insulating layers 31*b* (31*b*$_1$ to 31*b*$_{27}$) and 31*c* (31*c*$_1$ to 31*c*$_{27}$). Via conductors 33*a* and 33*d* are respectively provided in the insulating layers 31*a* and 31*d*. The coil conductors 32*b* (32*b*$_1$ to 32*b*$_{27}$) and 32*c* (32*c*$_1$ to 32*c*$_{27}$) each include a line portion and land portions disposed at the ends of the line portion. As illustrated in FIG. 4, it is preferable that the land portions be slightly larger than the line width of the line portions.

The coil conductors 32*b* (32*b*$_1$ to 32*b*$_{27}$) and 32*c* (32*c*$_1$ to 32*c*$_{27}$) are respectively provided on main surfaces of the insulating layers 31*b* (31*b*$_1$ to 31*b*$_{27}$) and 31*c* (31*c* to 31*c*$_{27}$) and are stacked together with the insulating layers 31*a* and 31*d*. In FIG. 4, each coil conductor has a ½ turn shape and the coil conductors 32*a*$_n$ and 32*b*$_n$ (n is a natural number from 1 to 27) are repeatedly stacked as one unit (one turn). Therefore, the number of coil conductors that are stacked in order to form the multilayer body 10 lies in a range from 50 to 60 (54 in FIGS. 3 and 4) and the number of turns of the coil is 27.

A coil having exactly 27 turns is formed by the coil conductors 32*a* (32*a*$_1$ to 32*a*$_{27}$) and 32*b* (32*b*$_1$ to 32*b*$_{27}$) in FIG. 4, but coil conductors for realizing positional adjustment may be used in addition to the coil conductors constituting the repeating parts of the coil depending on the positions of the via conductors and the shapes of the coil patterns. Such positional adjustment coil conductors would also be also included in the number of stacked coil conductors.

Furthermore, the insulating layers 31*a*, 31*b*$_1$, 31*c*$_1$, 31*a*$_{27}$, 31*b*$_{27}$, and 31*d* and the insulating layers 31*a*$_2$ to 31*a*$_{26}$ and 31*b*$_2$ to 31*b*$_{26}$ have different relative dielectric constants from each other. Specifically, a relative dielectric constant $\varepsilon r_1$ of the insulating layers 31*a*, 31*b*$_1$, 31*c*$_1$, 31*a*$_{27}$, 31*b*$_{27}$, and 31*d* is higher than a relative dielectric constant $\varepsilon r_2$ of the insulating layers 31*a*$_2$ to 31*a*$_{26}$ and 31*b*$_2$ to 31*b*$_{26}$. In the multilayer body 10 illustrated in FIGS. 3 and 4, the coil conductors included in the high-dielectric-constant portions 10*a* consist of the coil conductors 32*b*$_1$, 32*c*$_1$, 32*b*$_{27}$, and 32*c*$_{27}$. Therefore, the total number of stacked coil conductors included in the high-dielectric-constant portions 10*a* is less than or equal to eight (four in FIG. 4). The total number of stacked coil conductors included in the high-dielectric-constant portions 10*a* preferably lies in a range from 4 to 8.

The ratio of the length of the low-dielectric-constant portion 10*b* to the length $L_1$ of the multilayer body 10 preferably lies in a range from 80% to 95%. When the ratio of the length of the low-dielectric-constant portion 10*b* to the length $L_1$ of the multilayer body 10 lies in this range, it is easy to adjust the total number of stacked coil conductors included in the high-dielectric-constant portions 10*a* to be less than or equal to 8.

The via conductors 33*a*, 33*b* (33*b*$_1$ to 33*b*$_{27}$), 33*c* (33*c*$_1$ to 33*c*$_{27}$), and 33*d* are provided so as to respectively penetrate through the insulating layers 31*a*, 31*b* (31*b*$_1$ to 31*b*$_{27}$), 31*c* (31*c*$_1$ to 31*c*$_{27}$), and 31*d* in the stacking direction (x direction in FIG. 4).

The thus-configured insulating layers 31*a*, 31*b* (31*b*$_1$ to 31*b*$_{27}$), 31*c* (31*c*$_1$ to 31*c*$_{27}$), and 31*d* are stacked in the x direction, as illustrated in FIG. 4. Thus, the coil conductors 32*b* (32*b*$_1$ to 32*b*$_{27}$) and 32*c* (32*c*$_1$ to 32*c*$_{27}$) are electrically connected to each other by the via conductors 33*b* (33*b*$_1$ to 33*b*$_{27}$) and 33*c* (33*c*$_1$ to 33*c*$_{27}$). As a result, a solenoid coil having a coil axis that extends in the x direction is formed inside the multilayer body 10.

In addition, the via conductors 33*a* and 33*d* form connection conductors inside the multilayer body 10 and are exposed at the two end surfaces of the multilayer body 10. A first connection conductor 41 is connected in a straight line between the first outer electrode 21 and the coil conductor 32*b*1 that faces the first outer electrode 21 and a second connection conductor 42 is connected in a straight line between the second outer electrode 22 and the coil conductor 32*c*27 that faces the second outer electrode 22 inside the multilayer body 10.

As described above, stray capacitances that are generated between the coil and the outer electrodes 21 and 22 are small in the multilayer coil component 1 and the multilayer coil component 1 has excellent radio-frequency characteristics. Regarding radio-frequency characteristics in a high-frequency band (in particular, a band from 30 GHz to 80 GHz), a transmission coefficient S21 at 40 GHz preferably lies in a range from −1 dB to 0 dB and the transmission coefficient S21 at 50 GHz preferably lies in a range from −1 dB to 0 dB. When the multilayer coil component 1 satisfies the above conditions, for example, the multilayer coil component 1 can be suitably used in a bias-tee circuit inside an optical communication circuit. The transmission coefficient S21 is obtained from the ratio of the power of a transmitted signal to the power of an input signal. The transmission coefficient S21 at each frequency can be obtained using a network analyzer, for example. The transmission coefficient S21 is basically a dimensionless quantity, but is usually expressed in dB using the common logarithm.

The coil conductors forming the coil preferably overlap in a plan view from the stacking direction. In addition, the coil preferably has a substantially circular shape in a plan view from the stacking direction. In the case where the coil includes land portions, the shape of the coil is taken to be the shape obtained by removing the land portions (i.e., the shape of the line portions). In addition, in the case where land portions are connected to the via conductors forming the connection conductors, the shape of the connection conductors is the shape obtained by removing the land portions (i.e., the shape of the via conductors).

The phrase "the first connection conductor 41 is connected in a straight line between the first outer electrode 21 and the coil" means that the via conductors 33*a* forming the first connection conductor 41 overlap one another in a plan view from the stacking direction and it is not necessary for the via conductors 33*a* to be perfectly arranged in a straight line. In addition, the phrase "the second connection conductor 42 is connected in a straight line between the second outer electrode 22 and the coil" means that the via conductors 33*f* forming the second connection conductor 42 overlap one another in a plan view from the stacking direction and it is not necessary for the via conductors 33*f* to be perfectly arranged in a straight line. In the case where land portions are connected to the via conductors forming the connection conductors, the shape of the connection conductors is the shape obtained by removing the land portions (i.e., the shape of the via conductors).

The coil conductors illustrated in FIG. 4 are shaped so that the repeating pattern has a substantially circular shape, but the coil conductors may instead be shaped so that the repeating pattern has a substantially polygonal shape such as a substantially quadrangular shape. In addition, the repeating pattern may be a ¾ turn shape or another shape rather than a ½ turn shape.

In a plan view from the stacking direction, the line width of the line portions of the coil conductors preferably lies in a range from 30 μm to 80 μm and more preferably lies in the range from 30 μm to 60 μm. In the case where the line width of the line portions is smaller than 30 μm, the direct-current resistance of the coil may be large. In the case where the line width of the line portions is larger than 80 μm, the electrostatic capacitance of the coil may be large, and therefore the radio-frequency characteristics of the multilayer coil component 1 may be degraded.

The multilayer coil component 1 of the embodiment of the present disclosure is preferably configured so that the land portions are not positioned inside the inner periphery of the line portions and partially overlap the line portions in a plan view from the stacking direction. If the land portions are positioned inside the inner periphery of the line portions, the impedance may undesirably decrease. In addition, the diameter of the land portions is preferably 1.05 to 1.3 times the line width of the line portions in a plan view from the stacking direction. If the diameter of the land portions is less than 1.05 times the line width of the line portions, the connections between the land portions and the via conductors may be unsatisfactory. On the other hand, if the diameter of the land portions is greater than 1.3 times the line width of the line portions, the radio-frequency characteristics may be degraded due to the stray capacitances arising from the land portions becoming larger.

The shape of the land portions in a plan view from the stacking direction may be a substantially circular shape or may be a substantially polygonal shape. In the case where the shape of the land portions is a substantially polygonal shape, the diameter of the land portions is taken to be the diameter of an area-equivalent circle of the polygonal shape.

Specific examples of the preferred dimensions of the coil conductors and connection conductors will be described hereafter for cases where the size of the multilayer coil component 1 is the 0603 size, the 0402 size, and the 1005 size.

1. Multilayer coil component is 0603 size

The inner diameter (coil diameter) of each coil conductor preferably lies in a range from 50 μm to 100 μm in a plan view from the stacking direction.

The length of each connection conductor preferably lies in a range from 15 μm to 45 μm and more preferably lies in a range from 15 μm to 30 μm.

The width of each connection conductor preferably lies in a range from 30 μm to 60 μm.

2. Multilayer coil component 1 is 0402 size

The inner diameter (coil diameter) of each coil conductor preferably lies in a range from 30 μm to 70 μm in a plan view from the stacking direction.

The length of each connection conductor preferably lies in a range from 10 μm to 30 μm and more preferably lies in a range from 10 μm to 25 μm.

The width of each connection conductor preferably lies in a range from 20 μm to 40 μm.

3. Multilayer coil component 1 is 1005 size

The inner diameter (coil diameter) of each coil conductor preferably lies in a range from 80 μm to 170 μm in a plan view from the stacking direction.

The length of each connection conductor preferably lies in a range from 25 μm to 75 μm and more preferably lies in a range from 25 μm to 50 μm.

The width of each connection conductor preferably lies in a range from 40 μm to 100 μm.

In the multilayer coil component 1 according to the embodiment of the present disclosure, the insulating layers constituting the multilayer body 10 are composed of a material containing at least one out of a magnetic material and a non-magnetic material. The insulating layers forming the high-dielectric-constant portions and the insulating layers forming the low-dielectric-constant portion include different amounts of the non-magnetic material.

A ferrite material is an example of the magnetic material included in the insulating layers. It is preferable that the ferrite material be a Ni—Zn—Cu ferrite material. In addition, it is preferable that the ferrite material contain Fe in the form of $Fe_2O_3$ at 40 to 49.5 mol %, Zn in the form of ZnO at 2 to 35 mol %, Cu in the form of CuO at 6 to 13 mol %, and Ni in the form of NiO at 10 to 45 mol %. The ferrite material may also include inevitable impurities.

An example of the non-magnetic material included in the insulating layers is an oxide material containing Si and Zn (hereafter, also referred to as a first non-magnetic material). An example of such a material is a material represented by a general formula $aZnO\text{-}SiO_2$ and is a material having a value of a, that is, the content of Zn with respect to Si (Zn/Si) that lies in a range from 1.8 to 2.2. This material is also called willemite. In addition, it is preferable that the material further include Cu and specifically the material may be a material in which some of the Zn has been replaced with a dissimilar metal such as Cu. Such a material can be prepared by blending oxide raw materials (ZnO, $SiO_2$, CuO, etc.) so that the materials are at a prescribed molar ratio and mixing and pulverizing the materials in a wet state, and then calcining the mixture at a temperature in a range from 1000° C. to 1300° C.

Furthermore, another example of the non-magnetic material included in the insulating layers (hereafter, also referred to as a second non-magnetic material) is a material that includes a material obtained by adding a filler to a glass material containing Si, K, and B, the filler containing at least one selected from a group consisting of quartz and alumina. The glass material is preferably a material containing Si in the form of $SiO_2$ at 70 to 85 wt %, B in the form of $B_2O_3$ at 10 to 25 wt %, K in the form of $K_2O$ at 0.5 to 5 wt %, and Al in the form of $Al_2O_3$ at 0 to 5 wt %. This material can be prepared by mixing together a glass and a filler. For example, the material can be prepared by mixing together 40 to 60 parts by weight of quartz and 0 to 10 parts by weight of alumina as a filler with respect to 100 parts by weight of glass.

As a combination of the ferrite material and a nonmagnetic material, the ferrite material and the first non-magnetic material may be combined or the ferrite material and the second non-magnetic material may be combined. In addition, the ferrite material, the first non-magnetic material, and the second non-magnetic material may be combined. The combination consisting of the ferrite material and the first non-magnetic material is preferable.

The relative dielectric constant of the insulating layers is changed by changing the proportion of the non-magnetic material contained in the insulating layers. In other words, when two different types of insulating layers that include different proportions of the non-magnetic material included in the insulating layers are prepared, the insulating layers containing a lower proportion of the non-magnetic material and having a comparatively higher relative dielectric constant will form the high-dielectric-constant portions and the insulating layers containing a higher proportion of the non-magnetic material and having a comparatively lower relative dielectric constant will form the low-dielectric-constant portion.

The relative dielectric constant $\varepsilon_{r1}$ of the high-dielectric-constant portions preferably lies in a range from 12 to 20. The proportion of the non-magnetic material included in the high-dielectric-constant portions preferably lies in a range from 0 to 20 vol %.

The relative dielectric constant $\varepsilon_{r2}$ of the low-dielectric-constant portion preferably lies in a range from 5 to 10. The low-dielectric-constant portion is preferably formed of a composite material including a magnetic material and a non-magnetic material. The non-magnetic material preferably includes an oxide material containing Si and Zn and the content of Zn with respect to Si (Zn/Si) of the oxide material preferably lies in a range from 1.8 to 2.2 in terms of a molar ratio. The proportion of the non-magnetic material included in the low-dielectric-constant portion preferably lies in a range from 20 to 80 vol %.

Method of Manufacturing Multilayer Coil Component

Hereafter, an example of a method of manufacturing a multilayer coil component according to an embodiment of the present disclosure will be described.

First, ceramic green sheets, which will form the insulating layers, are manufactured. For example, an organic binder such as a polyvinyl butyral resin, an organic solvent such as ethanol or toluene, and a dispersant are added to a magnetic material and a non-magnetic material and the resultant mixture is kneaded to form a slurry. After that, ceramic green sheets having a thickness of around 12 μm are obtained using a method such as a doctor blade technique. At this time, two different types of ceramic green sheets having different non-magnetic material contents are prepared. Ceramic green sheets having a comparatively high non-magnetic material content are ceramic green sheets for forming the low-dielectric-constant portion and ceramic green sheets having a comparatively low non-magnetic material content are ceramic green sheets for forming the high-dielectric-constant portions.

For example, as a ferrite material serving as the magnetic material, a Ni—Zn—Cu ferrite material (oxide mixed powder) having an average particle diameter of about 2 μm can be used that is obtained by mixing together iron, nickel, zinc and copper oxide raw materials, calcining the raw materials at 800° C. for one hour, pulverizing the mixture using a ball mill, and then drying the resulting mixture. In addition, it is preferable that the ferrite material contain Fe in the form of $Fe_2O_3$ at 40 to 49.5 mol %, Zn in the form of ZnO at 2 to 35 mol %, Cu in the form of CuO at 6 to 13 mol %, and Ni in the form of NiO at 10 to 45 mol %.

As the non-magnetic material, an oxide material containing Si and Zn (above-described first non-magnetic material) can be used. Such a material can be prepared by blending oxide raw materials (ZnO, $SiO_2$, CuO, etc.) so that the materials are at a prescribed molar ratio and mixing and pulverizing the materials in a wet state, and then calcining the mixture at a temperature in a range from 1000° C. to 1300° C. In the case of the ceramic green sheets for forming the high-dielectric-constant portions, the non-magnetic material is preferably contained at 0 to 20 vol %. In the case of the ceramic green sheets for forming the low-dielectric-constant portions, the non-magnetic material is preferably contained at 20 to 80 vol %.

Furthermore, as the non-magnetic material, a material (above-described second non-magnetic material) that includes a material obtained by adding a filler to a glass material containing Si, K, and B, the filler containing at least one selected from a group consisting of quartz and alumina can be used. The glass material is preferably a material containing Si in the form of $SiO_2$ at 70 to 85 wt %, B in the form of $B_2O_3$ at 10 to 25 wt %, K in the form of $K_2O$ at 0.5 to 5 wt %, and Al in the form of $Al_2O_3$ at 0 to 5 wt %. This material can be prepared by mixing together a glass and a filler. For example, the material can be prepared by mixing together 40 to 60 parts by weight of quartz and 0 to 10 parts by weight of alumina as a filler with respect to 100 parts by weight of glass.

Via holes having a diameter of around 20 μm to 30 μm are formed by subjecting the manufactured ceramic green sheets to prescribed laser processing. Using a Ag paste on specific sheets having via holes, coil sheets are formed by filling the via holes to form via conductors and screen-printing and drying prescribed coil-looping conductor patterns (coil conductors consisting of line portions and land portions) having a thickness of around 11 μm.

The coil sheets are stacked so that a coil having a looping axis (coil axis) in a direction parallel to the mounting surface is formed in the multilayer body after division into individual components and so as to satisfy the following conditions.

- The ceramic green sheets for forming the low-dielectric-constant portion are arranged in the center in the stacking direction and the ceramic green sheets for forming the high-dielectric-constant portions are arranged at both ends in the stacking direction.
- The number of stacked coil sheets lies in a range from 50 to 60.

The number of coil sheets in which ceramic green sheets for forming the high-dielectric-constant portions are used is less than or equal to 8.

The length of the region in which the coil conductors are arranged in the stacking direction of the multilayer body after division into individual chips lies in a range from 85% to 95% the length of the multilayer body.

The multilayer body is subjected to thermal pressure bonding in order to obtain a pressure-bonded body, and then the pressure-bonded body is cut into pieces of a predetermined chip size to obtain individual chips. The divided chips may be processed using a rotary barrel in order to round the corner portions and edge portions thereof.

Binder removal and firing is performed at a predetermined temperature and for a predetermined period of time, and fired bodies (multilayer bodies) having a built-in coil are obtained.

The chips are dipped at an angle in a layer obtained by spreading Ag paste to a predetermined thickness and then baked to form a base electrode of an outer electrode on four surfaces (a main surface, an end surface, and both side surfaces) of the multilayer body. In the above-described method, the base electrode can be formed in one go in contrast to the case where the base electrode is formed separately on the main surface and the end surface of the multilayer body in two steps.

Formation of the outer electrodes is completed by sequentially forming a Ni film and a Sn film having predetermined thicknesses on the base electrodes by performing plating. A multilayer coil component according to an embodiment of the present disclosure can be manufactured as described above.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body that is formed by stacking a plurality of insulating layers on top of one another in a length direction and that has a coil built into the inside thereof; and a first outer electrode and a second outer electrode that are electrically connected to the coil;

wherein the coil is formed by a plurality of coil conductors stacked in the length direction together with the insulating layers being electrically connected to each other, the multilayer body has a first end surface and a second end surface, which face each other in the length direction, a first main surface and a second main surface, which face each other in a height direction perpendicular to the length direction, and a first side surface and a second side surface, which face each other in a width direction perpendicular to the length direction and the height direction, the first outer electrode extends along and covers a portion of the first end surface and a portion of the first main surface, the second outer electrode extends along and covers a portion of the second end surface and a portion of the first main surface, the first main surface is a mounting surface, a stacking direction of the multilayer body and a coil axis direction of the coil are parallel to the first main surface, the multilayer body includes a low-dielectric-constant portion, which is arranged at a substantially central region in the stacking direction and has a comparatively low relative dielectric constant relative to both ends in the stacking direction, and high-dielectric-constant portions, which are arranged at the both ends and have a comparatively high dielectric constant relative to the substantially central region, a length of a region in which the coil conductors are arranged in the stacking direction is in a range from 85% to 90% of a length of the multilayer body, a number of stacked coil conductors is in a range from 50 to 60, a total number of stacked coil conductors included in the high-dielectric-constant portions is less than or equal to 8, and all of the high-dielectric-constant portions on the first main surface are covered with the first outer electrode and the second outer electrode.

2. The multilayer coil component according to claim 1, wherein the total number of stacked coil conductors included in the high-dielectric-constant portions is less than or equal to 4.

3. The multilayer coil component according to claim 1, wherein a relative dielectric constant $\varepsilon r_1$ of the low-dielectric-constant portion is in a range from 5 to 10, and a relative dielectric constant $\varepsilon r_2$ of the high-dielectric-constant portions is in a range from 12 to 20.

4. The multilayer coil component according to claim 1, wherein the low-dielectric-constant portion is made of a composite material including a magnetic material and a non-magnetic material.

5. The multilayer coil component according to claim 4, wherein the non-magnetic material includes an oxide material containing Si and Zn, and content of Zn relative to Si (Zn/Si) is in a range from 1.8 to 2.2 in terms of a molar ratio.

6. The multilayer coil component according to claim 1, wherein the length of the multilayer body is in a range from 560 μm to 600 μm.

7. The multilayer coil component according to claim 2, wherein a relative dielectric constant $\varepsilon r_1$ of the low-dielectric-constant portion is in a range from 5 to 10, and a relative dielectric constant $\varepsilon r_2$ of the high-dielectric-constant portions is in a range from 12 to 20.

8. The multilayer coil component according to claim 2, wherein the low-dielectric-constant portion is made of a composite material including a magnetic material and a non-magnetic material.

9. The multilayer coil component according to claim 3, wherein the low-dielectric-constant portion is made of a composite material including a magnetic material and a non-magnetic material.

10. The multilayer coil component according to claim 7, wherein the low-dielectric-constant portion is made of a composite material including a magnetic material and a non-magnetic material.

11. The multilayer coil component according to claim 8, wherein the non-magnetic material includes an oxide material containing Si and Zn, and content of Zn relative to Si (Zn/Si) is in a range from 1.8 to 2.2 in terms of a molar ratio.

12. The multilayer coil component according to claim 9, wherein the non-magnetic material includes an oxide material containing Si and Zn, and content of Zn relative to Si (Zn/Si) is in a range from 1.8 to 2.2 in terms of a molar ratio.

13. The multilayer coil component according to claim 10, wherein the non-magnetic material includes an oxide material containing Si and Zn, and content of Zn relative to Si (Zn/Si) is in a range from 1.8 to 2.2 in terms of a molar ratio.

14. The multilayer coil component according to claim 2, wherein the length of the multilayer body is in a range from 560 μm to 600 μm.

15. The multilayer coil component according to claim 3, wherein the length of the multilayer body is in a range from 560 μm to 600 μm.

16. The multilayer coil component according to claim 4, wherein the length of the multilayer body is in a range from 560 μm to 600 μm.

17. The multilayer coil component according to claim 5, wherein the length of the multilayer body is in a range from 560 μm to 600 μm.

18. The multilayer coil component according to claim 7, wherein the length of the multilayer body is in a range from 560 μm to 600 μm.

19. The multilayer coil component according to claim 8, wherein the length of the multilayer body is in a range from 560 μm to 600 μm.

20. The multilayer coil component according to claim 9, wherein the length of the multilayer body is in a range from 560 μm to 600 μm.

* * * * *